United States Patent [19]

Allen

[11] 4,151,782

[45] May 1, 1979

[54] HANDGUN WITH INDEXING MEANS

[76] Inventor: Edward A. Allen, 173 Highland Ave., Westfield, Mass. 01085

[21] Appl. No.: 809,022

[22] Filed: Jun. 22, 1977

[51] Int. Cl.[2] ..... F41D 7/04

[52] U.S. Cl. ..... 89/155; 42/1 S; 89/145; 89/161

[58] Field of Search ..... 89/155, 156, 157, 161; 42/10, 11

[56] References Cited

U.S. PATENT DOCUMENTS

| | | | |
|---|---|---|---|
| 726,109 | 4/1903 | Stow | 89/155 |
| 932,183 | 8/1909 | Schwarzlose | 89/161 |
| 1,487,722 | 3/1924 | Coenders | 89/155 |
| 2,699,006 | 1/1955 | Maerk | 89/161 |
| 2,835,171 | 5/1958 | Lyon | 89/161 |

FOREIGN PATENT DOCUMENTS

| | | | |
|---|---|---|---|
| 10587 of | 1886 | United Kingdom | 89/161 |
| 180238 | 5/1922 | United Kingdom | 89/161 |

*Primary Examiner*—Stephen C. Bentley

*Attorney, Agent, or Firm*—Chapin, Neal & Dempsey

[57] ABSTRACT

A handgun which combines the reliability of a revolver and the convenience of an automatic wherein said handgun is provided with a barrel which moves forwardly in response to the firing of a cartridge. Said forward movement and the reverse thereof being responsible for the indexing of a cylinder-like cartridge carrier by means of indexing levers operatively connected between said barrel and said cartridge carrier and the cocking of the lockwork of the handgun.

10 Claims, 37 Drawing Figures

MRF + LR, CONV.
DOM.
10
12
14
16
18
20
22
24
25
26
28
30
4
98
124
132
164

12
14
16
26
30
38
56
71
98
132
134
136
164
166
5

14
12
150
144
38
146

14
150
12

14
150
12
143
144

14
12
143
144
146

.22 M.R.F.
150

52
146
144
38

52
38

150
52

HANDGUN WITH INDEXING MEANS

BACKGROUND

The present invention relates to firearms. In particular, it relates to a handgun which combines the reliability of a revolver and the convenience of an automatic.

Down through the history of handgun manufacture, two basic designs have been of primary importance, (a) revolvers and (b) automatics or self-loaders. Revolvers, on the one hand, have generally been considered to be the more reliable weapon, while automatics, on the other hand, the more convenient to use. Assuming that both schools of thought are correct, then a handgun which combines the best features of each basic type is highly desirable.

In the main, shooters are concerned with weapons for two types of cartridges, rim fire and center fire. Specifically, the most popular are the 0.22 LR and 0.45 ACP cartridges with some emphasis on 0.22 MRF cartridges. The weapon of the present invention may be easily modified to handle all such cartridges.

Accordingly, it is an object of the present invention to provide a handgun which combines the reliability of a revolver and the convenience of an automatic and which is accurate, powerful and safe.

It is another object of the present invention to provide a handgun which offers 100% case support for 0.22 MRF cartridges as well as all other types of cartridges used therein and which is convertible to 0.22 LR cartridges.

It is another object of the present invention to provide an auto six gun which is of the standing breech type and which is a self-loader.

It is a further object of the present invention to provide a handgun wherein the center of the barrel is tangent to the top of the hand holding the handgun.

It is a further object of the present invention to provide a handgun wherein the barrel is moved forward upon the firing of a cartridge.

It is a further object of the present invention to provide an auto six gun which has no extractor, ejector, magazine, slide, or ejection ports which may cause malfunction.

It is a still further object of the present invention to provide a handgun having a cylinder-like cartridge carrier which is indexed in response to barrel movement occasioned by the firing of a cartridge.

The above and other objects and advantages of the present invention will become more clear from a consideration of the following description and drawings, in which:

FIG. 3 is a sectional view taken along line 3—3 of FIG. 2;

Figures 1, 2:
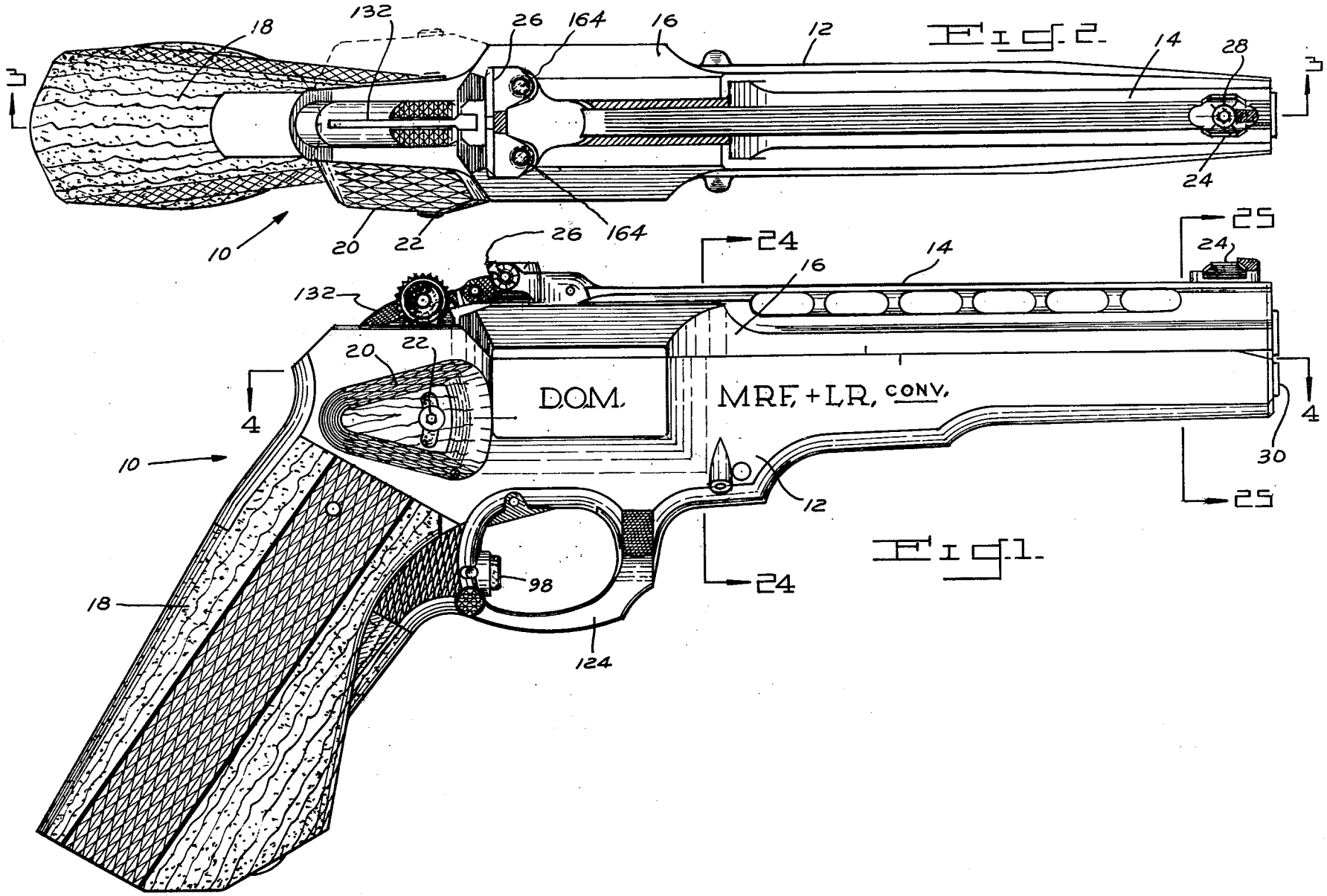
FIG. 1 is a side elevational view of the handgun of the present invention.
FIG. 2 is a top plan view of the handgun shown in FIG. 1.
Figures 1, 4, 26, 27:
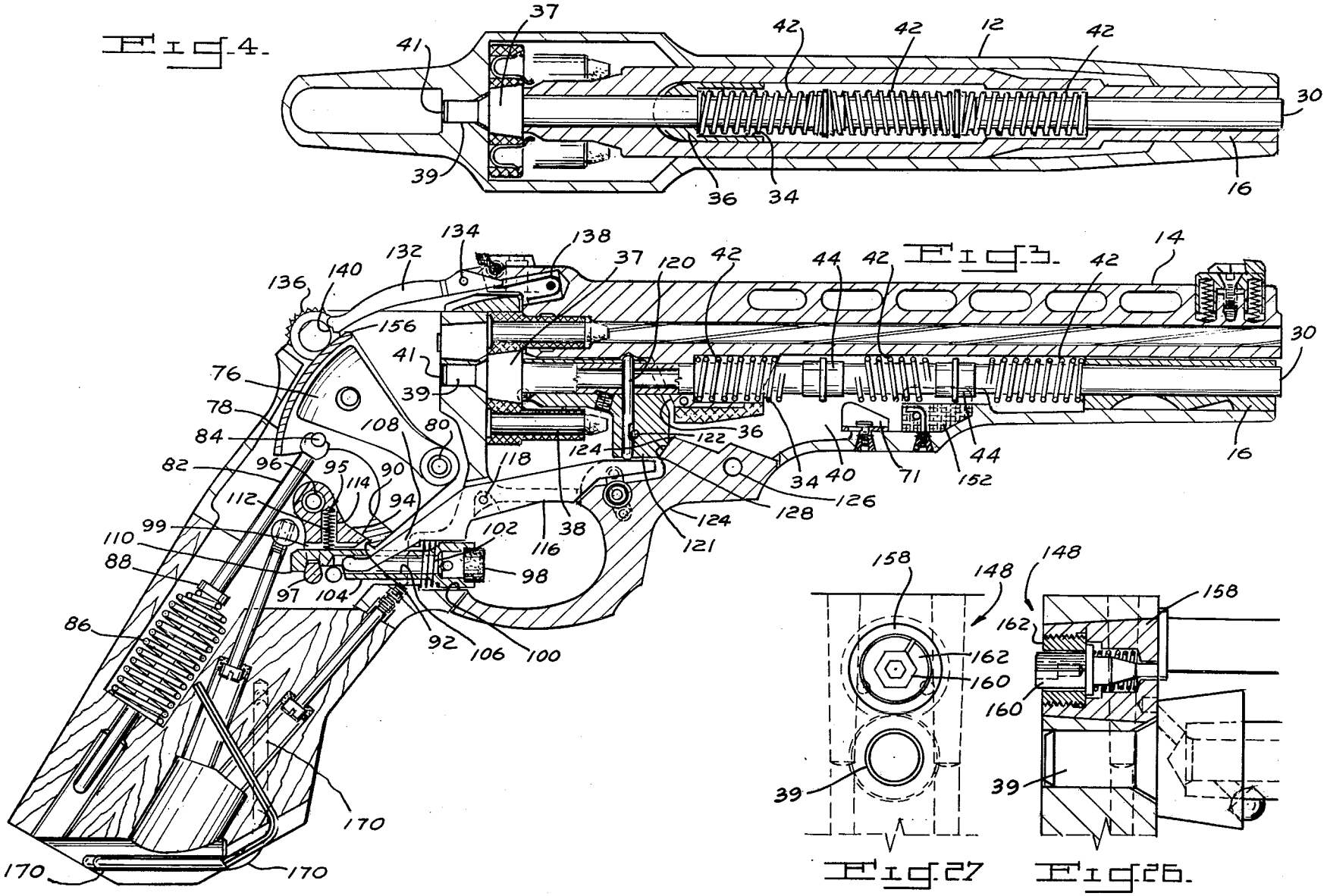
FIG. 4 is a sectional view taken substantially along the line 4—4 of FIG. 1 wherein the firing mechanism is not shown.
Figure 22:
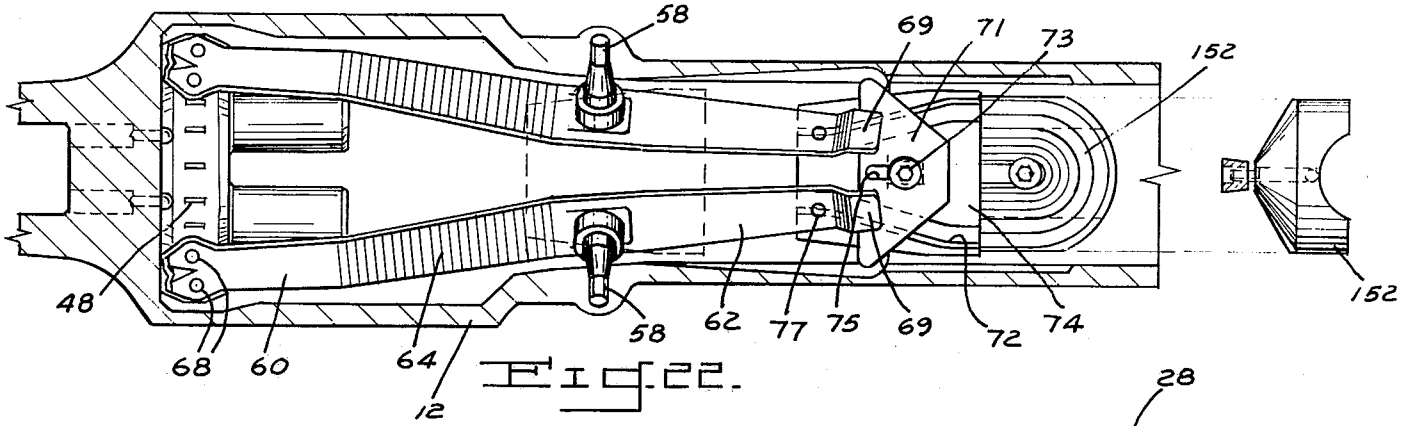
Figure 25:
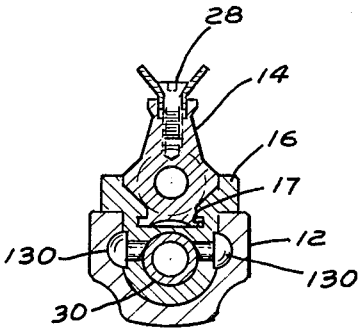
Figure 23:
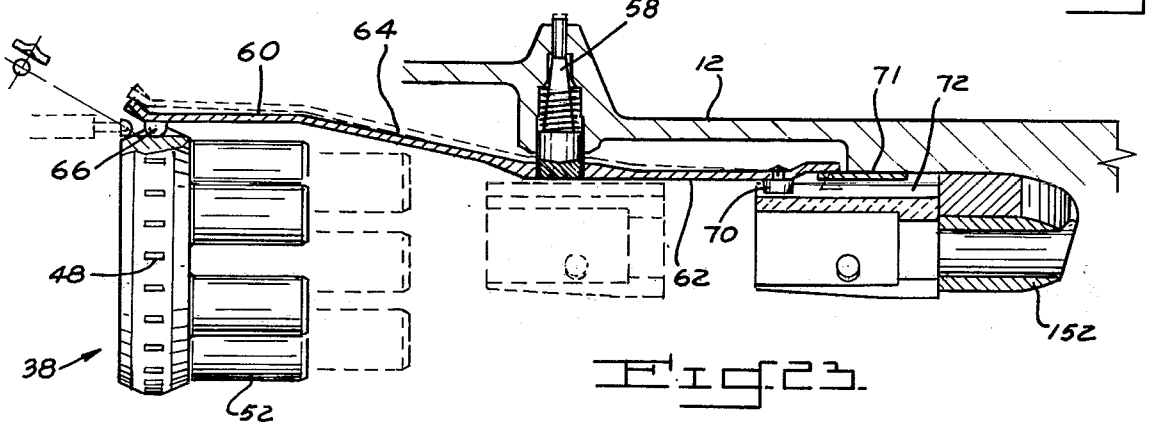
Figure 24:
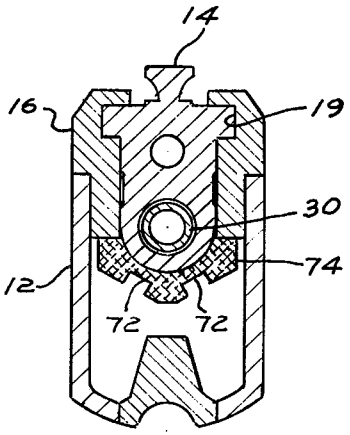

FIGS. 13*a*, 14*a*, 15*a* and 16*a* are enlarged partial views of the firing chamber area in corresponding FIGS. 13, 14, 15 and 16, respectively;

FIGS. 17, 18, 19, 20, and 21 are schematic representations of the cam levers indexing the cylinder in response to barrel movement;

FIGS. 17*a*, 18*a*, 19*a*, 20*a* and 21*a* are end views corresponding to FIGS. 17, 18, 19, 20 and 21, respectively;

FIG. 22 is a partial bottom view of the handgun of FIG. 1 having sections broken away and showing the cylinder indexing mechanism;

FIG. 23 is a partial side sectional view of the indexing mechanism shown in FIG. 22;

FIG. 24 is a sectional view taken along the line 24—24 of FIG. 1;

FIG. 25 is a sectional view taken along the line 25—25 of FIG. 1;

FIG. 26 is a partial sectional view of the firing pin assembly located in the standing breech of the handgun;

FIG. 27 is an end view of the firing pin assembly shown in FIG. 26; and

FIG. 28 is a partial sectional view of the rear portion of the barrel and barrel carrier of the handgun of FIG. 1.

Referring to FIGS. 1 and 2, the handgun of the present invention is shown at 10. As will be described in further detail below, the handgun basically comprises a frame 12, a barrel 14 and a barrel carrier 16.

As shown, the frame is provided with a grip or stock 18 and a thumb rest 20, which is releasably secured to the frame 12 by screw 22 so that it may be selectively positioned on either side of the frame so as to accommodate left or right-handed shooters. As further shown, the upper surface of the barrel 14 is provided with a front sight 24 mounted thereon by screw 28 and a pair of laterally adjustable sight blades 26 on the breech end.

Figures 8, 9, 10, 11, 12:
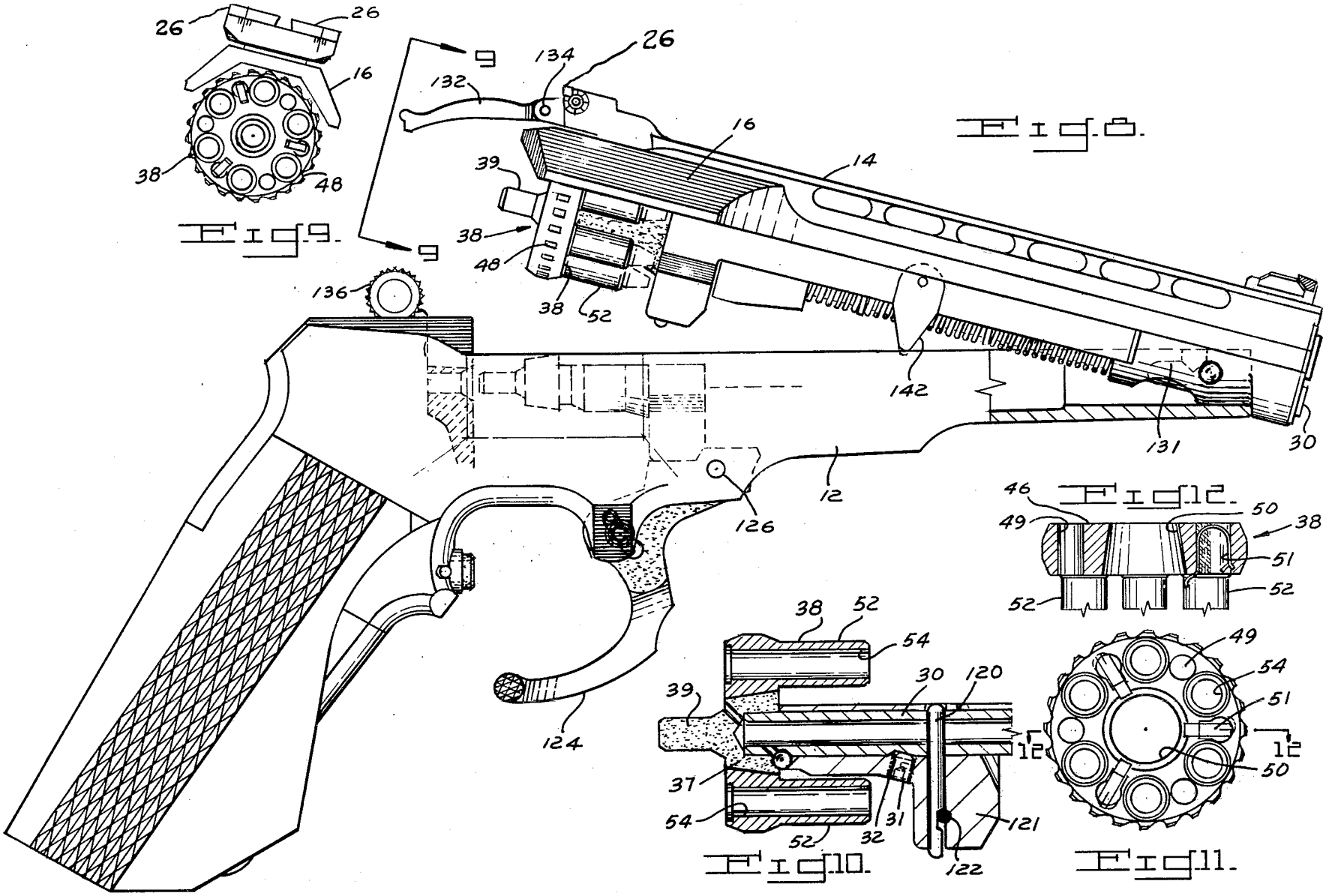
FIG. 9 is a view taken substantially along the line 9—9 of FIG. 8.
FIG. 10 is an enlarged partial side elevational sectional view of means by which the cylinder is carried by the handgun of the present invention.
FIG. 11 is an end view of the cylinder used in the handgun of the present invention.
FIG. 12 is a sectional view taken along the line 12—12 of FIG. 11.

As best seen in FIGS. 3–6 inclusive and FIGS. 24 and 25, the barrel 14 is slidably disposed on said barrel carrier 16 by means of front and rear slideways 17 and 19, respectively, in said carrier 16. As further shown, a tube or rod 30 is mounted centrally in the carrier 16 just below the axis of the barrel 14. Said tube 30, is held in said carrier 16 by set screw 31 in the rear section of the carrier bearing against a flat 32 in a corresponding rear section of the tube 30. See FIG. 10.

As shown, the tube 30 passes through an opening 34 in a depending lug 36 of said barrel 14. The inner end of the tube 30 is provided with means for supporting a revolvable cylinder 38. Said means comprising a tapered member 37 and an axial extension, such as pin 39, projecting from said supporting means and engageable with said frame 12.

The tube 30, which lies partially within a cavity 40 of the carrier 12, is provided with recoil means. Such means takes the form of a plurality of springs 42 disposed about said tube 30 and separated by slidably disposed spacers 44. The recoil means is positioned on said tube 30 between the forward end of the cavity 40 and the rear wall of opening 34 in the depending lug 36 of the barrel 14. Accordingly, the springs are compressed by forward movement of the barrel 14, as will be explained below.

Referring now primarily to FIGS. 8–11 inclusive, it will be noted that the cylinder 38 is unusual in design and may more properly be referred to as a cluster of bushings. In general, the cylinder comprises a cylindrical base member 46 having a toothed periphery 48 of fundamental ratchet form to permit rotation in only one direction, and an axially tapered mounting aperture 50 for rotatably mounting the same on the cylinder support means. As shown, the base member is provided with a plurality of forward projecting members 52 which are integral therewith. Cartridge receiving and supporting apertures 54 are provided in each of said projections 52. Said apertures 54 are designed so as to fully receive and support a cartridge of specified size and shape. As further shown, the base member 46 is also provided with a plurality of additional apertures 49, some of which are notched so as to snugly hold snap springs 51. Said snap springs 51 extend forwardly of said base member 46 into snap engagement with the cylinder support means to hold said cylinder on said means.

With reference to FIGS. 5, 7, 22 and 23, it will be noted that indexing means for the cylinder 38 is operatively disposed between the barrel 14 and the cylinder. As shown, such means comprises a pair of matched levers 56 disposed for pivotal and oscillating movement within the frame 12 beneath the barrel 14 on pins 58, the ends of which are mounted in the frame 12. Each lever 56 is comprised of two offset sections 60 and 62 connected by an inclined web 64. The breech end 60 of each lever 56 is provided with hard hemispherical pusher teeth 66, with shanks 68, which are designed to mesh with the toothed periphery 48 of the cylinder 38. The muzzle end 62 of each lever is provided with a small offset section 69 which engages fulcrum plate 71 affixed to the frame 12 by screw 73 passing through elongated slot 75 in said plate 71. Additionally, said section 62 is provided with a cam follower 70 which is disposed adjacent the offset section 69. Said cam followers 70 are engageable with cam slots 72 of cam 74 which is attached to the bottom of the depending lug 36 of the barrel 14. The operation of the levers 56 will be explained below.

The lockwork of the present handgun is best seen in FIGS. 1, 2, 3 and 4. A hammer 76, which is of limited motion, as will be described below, is disposed within the general confines of a hammer shell 78. Both the hammer 76 and the hammer shell 78 are pivotably mounted on pin 80 which is journaled between the side walls of the frame 12. The hammer shell is urged forwardly by the action of a push rod 82 which contacts a pin 84 mounted between the sides of the shell 78 at the rear thereof. Said push rod 82 extends downwardly into the grip 18 where it functionally engages hammer spring 86 via integral collar 88 on said rod 82. The shell 78 is also provided with a rearwardly extending projection 90 having a sear notch 92 thereon. The sear notch 92 is releasably engageable with sear 94 on member 95 which is pivotably disposed on pin 96 mounted between the side walls of the frame 12. Member 95 is also provided with a projection 97 which extends downwardly and has passage 99 therethrough.

A trigger 98, which is shown as a button type which may be made of rubber or the like is slidably disposed in a cavity 100 in the frame and is urged forwardly by spring 102. As shown, the trigger 98 has a rearward rod-like member 104 which extends into the grip portion of the weapon. Said rod-like member 104 is provided with an axially disposed cavity 106 and a slot 108 disposed in the top thereof which communicates with said cavity 106. Said rod-like member 104 is also provided with means for engaging the projection 97 of the member 95. As shown, said member 104 also has a hooked end 110 which is passed through passage 99 of said member 95. Said hooked end is urged downwardly by springs 112 disposed in cavity 114 of said member 95.

Interrupter means is also associated with the lockwork. To this end, an interrupter lever or bar 116 is pivotally mounted in the frame 12 on pine 118 and has one end thereof which extends through the slot 108 of member 104 into the cavity 106 thereof. The opposite end of the lever 116 is disposed beneath the cylinder 38 and contacts interrupter pin 120 which is slidably disposed in a hole vertically disposed in a depending portion 121 of the barrel carrier 16. (See FIG. 10.) The interrupter pin 120 which is normally urged upwardly by lever 116 is maintained in place by transverse pin 122 which engages a notch in the interrupter pin 120.

Figures 5, 6, 7, 8:
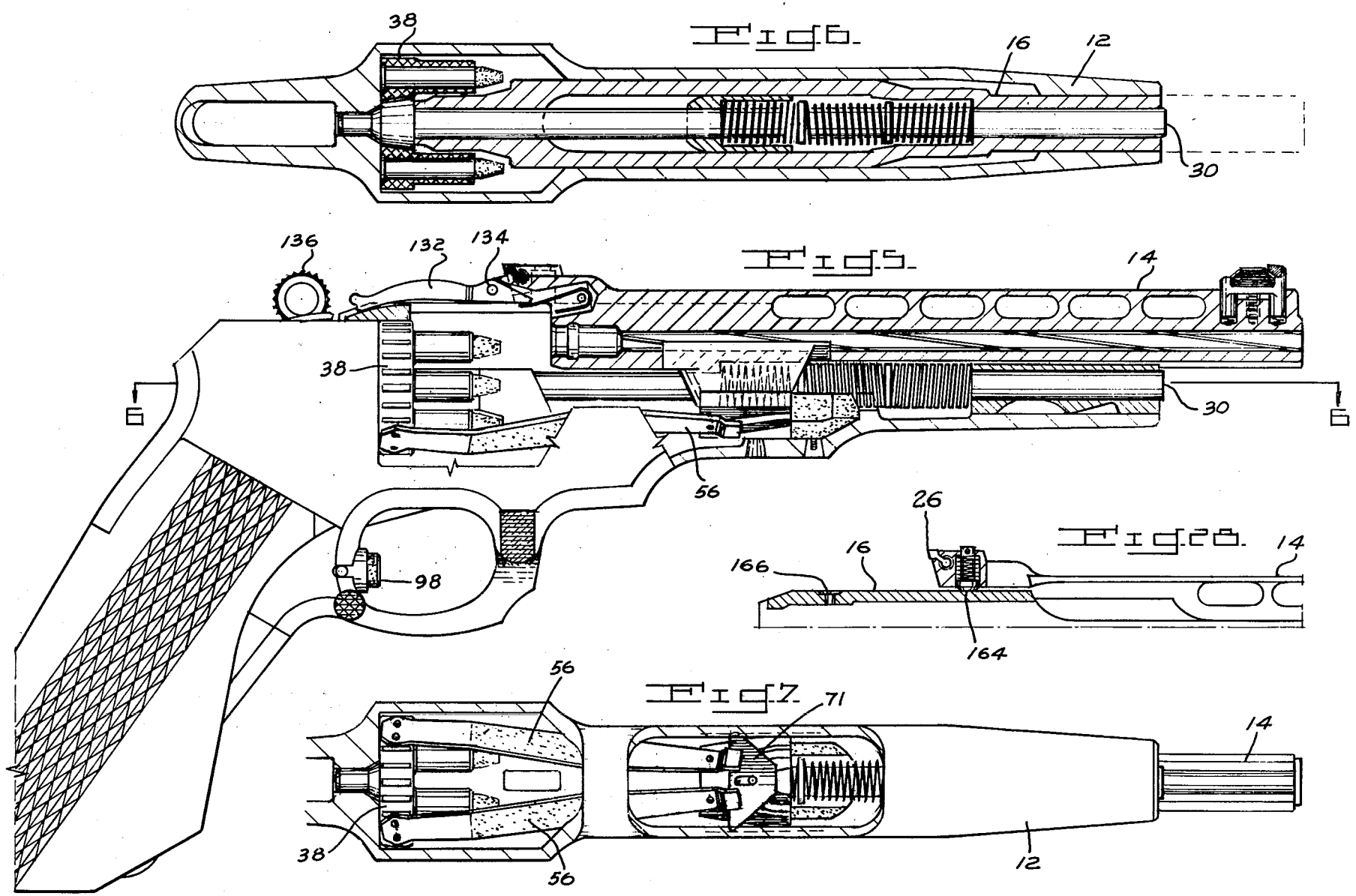
FIG. 5 is a side elevational view of the handgun of FIG. 1 having sections broken away and showing the barrel thereof in its forward position.
FIG. 6 is a sectional view taken substantially along the line 6—6 of FIG. 5 wherein the firing mechanism is not shown.
FIG. 7 is a partial bottom view of the handgun shown in FIG. 5 having sections broken away.
FIG. 8 is a side elevational view of the handgun of FIG. 1 in a loading and unloading position.

Referring to FIGS. 3 and 8, it will be noted that the trigger guard 124 is a lever which is pivotally mounted on pin 126 disposed in the lower part of the frame 12. While the guard does in fact guard the trigger 98, it also provides the means by which the weapon may be opened and closed for loading, unloading and cleaning purposes. As will be noted, the lever is provided with a boss 128 which while in contact with the forward end of depending portion 121 of the barrel carrier 16, securely locks the weapon against opening.

When lever 124 is pulled downward, the boss 128 clears the depending portion 121, thus permitting the barrel carrier 16 and the barrel 14 to be slid forward on round end hinge pins 130 in T-slots 131 a distance sufficient to allow the pin 39 to clear its aperture 41 in the frame 12. At this point, the barrel 14 and the barrel carrier 16 may be pivoted about hinge pins 130 (FIG. 25) adjacent the muzzle end of the weapon to the position shown in FIG. 8.

The hinge pins 130, which are pressed into the forward end of the barrel carrier, engage identical T-slots 131 on either side of the frame 12 and may be so positioned therein so as to enable the barrel carrier to be completely removed from the frame.

As shown in FIGS. 1, 2 and 3, cocking means for the hammer 76 is provided by a cocking finger 132 pivotally mounted on the top rear end of the barrel 14 on pine 134. the finger 132 extends rearwardly towards the hammer shell 78 passing between the bifurcated hammer spur 136. As the rear portion of the finger 132 is urged downward by the action of spring 138 contacting the underside of the opposite end thereof, the rearward free end of the finger 132 which is provided with notch 140 is engageable with the top forwardmost portion of the shell 78. As will be explained below, the contact between the shell 78 and the finger 132 provides the cocking action for the lock mechanism.

OPERATION

The operation of the firearm of the present invention is intricate yet precise. With the weapon in its open position as shown in FIG. 8, a cylinder 38 having cartridges inserted therein is positioned on the tapered member 37. When so loaded, the props 142 are pushed inwardly and the barrel and barrel carrier 14 and 16, respectively, pivot into the frame 12 about hinge pins 130, and the pin 39 brought into engagement with pin receiving aperture 41 in the standing breech portion of the frame 12. The barrel carrier 16 is secured in this position by the action of boss 128 contacting the forward portion of depending lug 121 of the barrel carrier when lever 124 is drawn to a closed position, such as shown in FIG. 3.

Figures 13, 13A, 14, 14A, 15, 15A, 16, 16A:
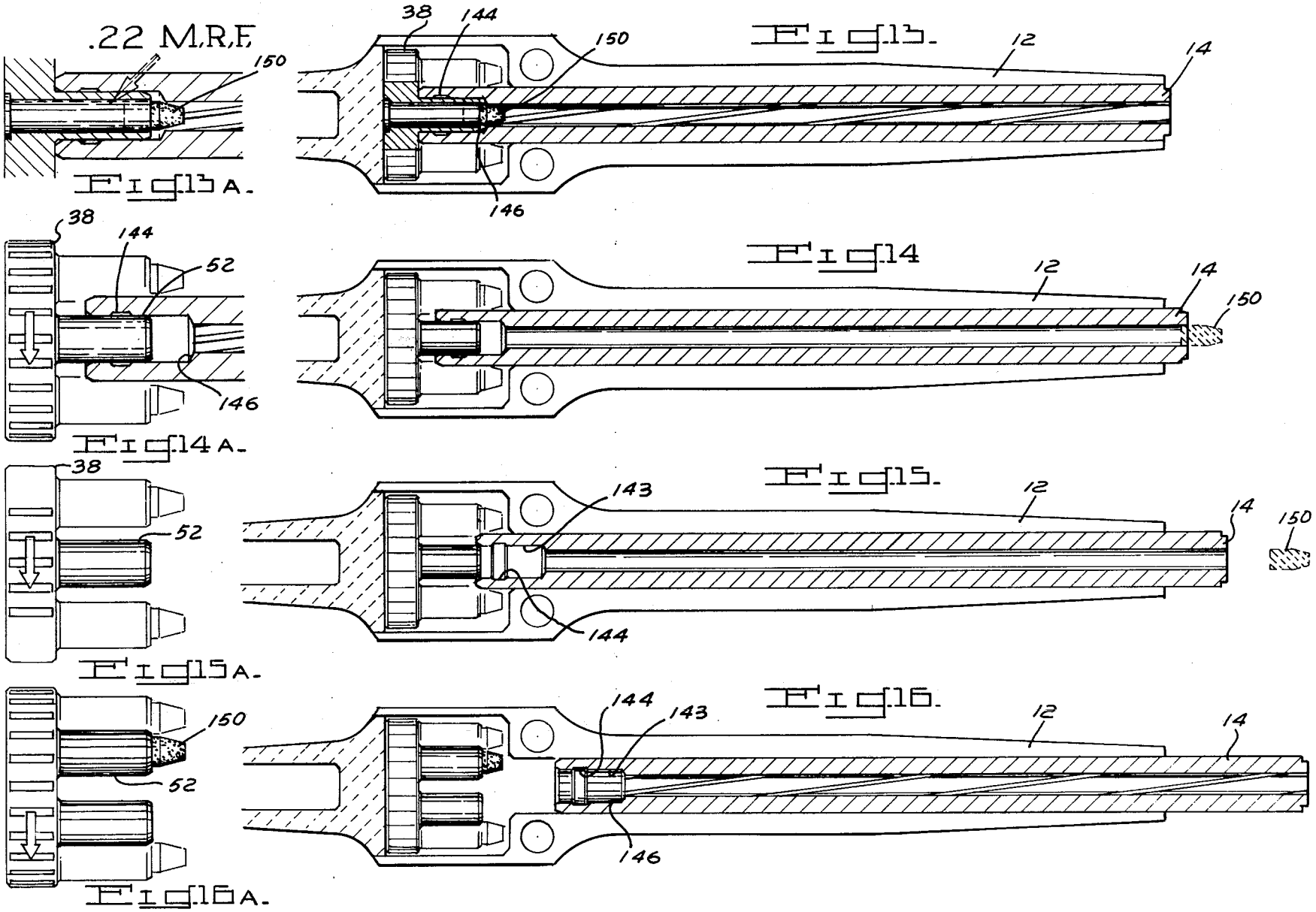
FIGS. 13, 14, 15 and 16 are schematic representations in cross section of the barrel movement during the firing sequence.
Figures 17, 17A:
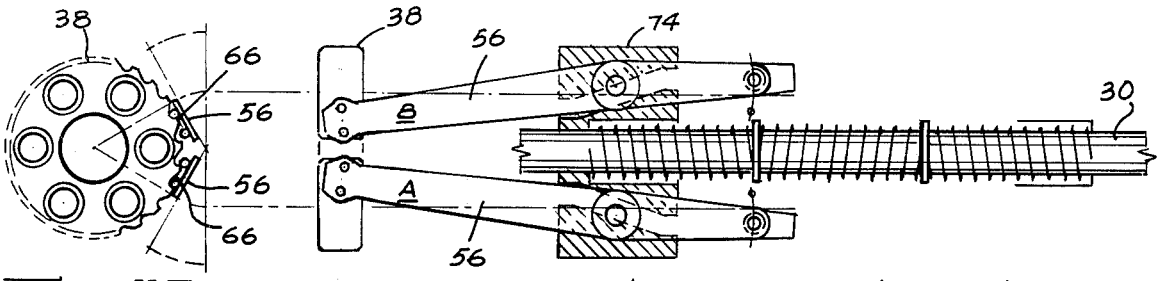
Figures 18, 18A:
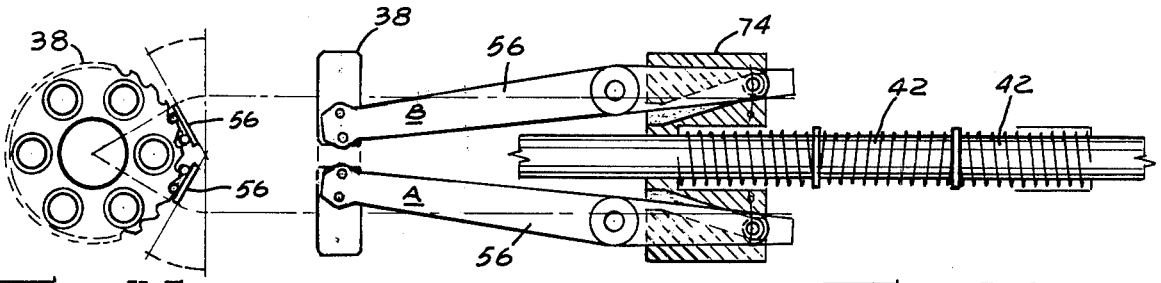
Figures 19, 19A:
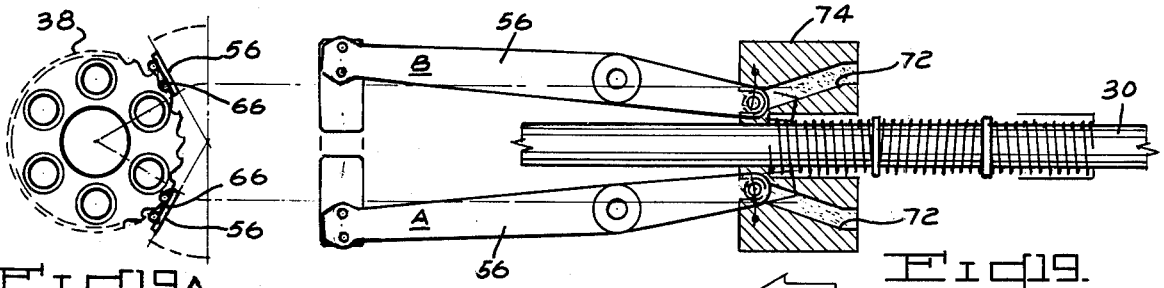
Figures 20, 20A:
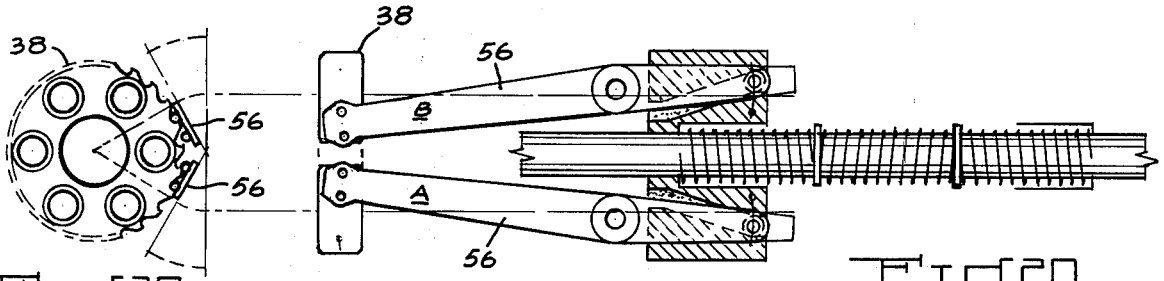
Figures 21, 21A:
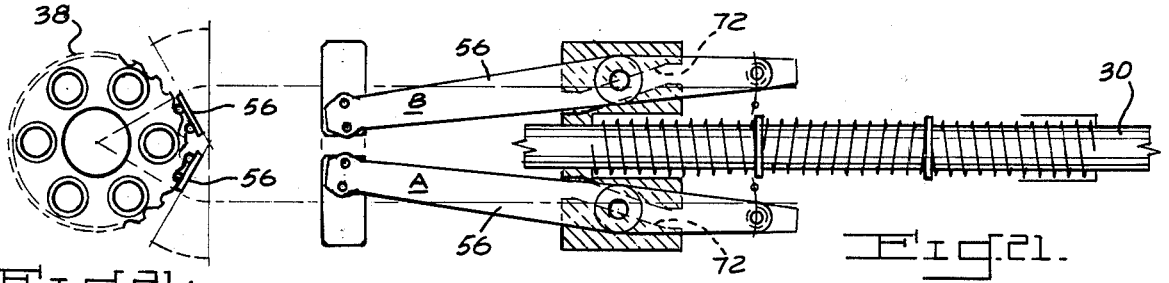

As also shown in FIG. 3, the breech end of the barrel 14 has received one of the forwardly projecting members 52 of the cylinder 38 with cartridges disposed in the cartridge receiving apertures 54 thereof. As best seen in FIG. 13*a*, the member 52 is slidably engageable with counterbore 143 in the breech end of the barrel 14. The counterbore 143, which is provided with a gas seal 144, extends beyond the end of the member 52 and terminates in shoulder 146, thus creating a gas trap. The presence of the gas trap and the shoulder 146 provides the means by which the barrel 14 is actuated forwardly as will be explained below.

With the weapon so loaded, it is prepared for firing by cocking the hammer 76 by rearward actuation of the hammer shell 78 by hammer spur 136. This action causes hammer spring 86 to be depressed and sear 94 to engage the sear notch 92. This condition of readiness is shown in FIG. 3.

In order to fire the weapon, the trigger 98 is depressed, which causes the sear notch 92 and the sear 94 to disengage in response to the rearward movement of member 104 against projection 97 of member 95. This in turn releases the hammer shell 78 with the floating hammer 76 therein which is urged against the firing pin assembly 148, shown in FIGS. 26 and 27. Said assembly comprises a plug 158 bored to receive a spring loaded firing pin 160 which is held in said bore by collar 162. The firing pin assembly which is depicted as a rim fire assemblage contacts the rear of the cartridge causing the same to fire.

Upon firing, the subsequent sequence of events within the weapon is best understood by reference to FIGS. 13 through 21 inclusive. At the instant of firing, the barrel 14, the cylinder 38 and the levers 56 are essentially in the state as shown in FIGS. 13, 13*a*, 17 and 17*a*. Once the slug 150 has cleared its cartridge and is within the confines of the bore of the barrel 14, gas pressure from the cartridge in the gas trap area working against the shoulder 146 of the counterbore 143 urges the barrel 14 on the carrier 16 forwardly against the biasing force of springs 42 and the holding force exerted by spring loaded ball detents 164 in recesses 166 provided in the top of the barrel carrier 16 (see FIG. 28). Said detents 164 are primarily provided to help hold the barrel against hammer fall and to prevent manual opening of the action. At the same instant, the cam 74 which is supported on the lug 36 of the barrel carrier 16 is also moved forward therewith.

With further forward movement of the barrel, such as to a position shown in FIGS. 14 and 14*a*, it will be noted that the barrel 14 has not yet cleared the projection 52 of the cylinder 38. When the barrel does clear the projection 52 of cylinder 38 such as shown in FIGS. 15 and 15*a*, the cam 74 engages the cam follower 70, causing the levers 56 to begin to pivot about pins 58. See FIGS. 18 and 18*a*. The movement of lever A from the position shown in FIG. 18 to the position shown in FIG. 19 causes the cylinder 38 to rotate approximately 30° due to the action of the pusher teeth 66 on lever A against the toothed periphery 48 of the cylinder 38. Once the barrel 14 has reached its forwardmost movement as detailed in FIGS. 16, 16*a*, 19 and 19*a* and in FIG. 5, further movement is stopped by the cam coming into contact with the bumper 152. At this point, the travel of the barrel is reversed under the influence of springs 42.

As the barrel begins its reverse movement, the cam urges the cam followers 70 away from each other thus urging the other end of the levers toward each other. Accordingly, the cylinder 38 is rotated an additional 30° under the influence of pusher teeth 66 as lever B contacts the toothed periphery 48 of the cylinder 38. The cylinder's rotation is essentially completed by the time the barrel 14 returns to a position, such as that shown in FIGS. 15, 15*a*, 20 and 20*a*. When the barrel 14 finally returns to rest, as shown in FIGS. 13, 13*a*, 21 and 21*a*, the cylinder 38 has been rotated a full 60° and a different projecting member 54 with a cartridge therein is received by the counterbore of the barrel 14.

Not only does the movement of the barrel 14 on barrel carrier 16 index the cylinder 38, it also accounts for the cocking of the hammer 76 in order to fire a subsequent round. As explained above, the cocking finger 132 is pivotally mounted on the top rear end of the barrel 14 on pin 134 (see FIGS. 3 and 8). The forward end of the finger 132 is urged upwardly by spring 138 located in slot 154 disposed beneath rear sight blades 26. When the hammer 76 is in its cocked position, the rearward portion of finger 132 is disposed above the hammer shell 78 between the bifurication of hammer spur 136. Upon release of the firing mechanism and the subsequent firing of the weapon, the barrel 14 is driven forward and thus carries the finger along with it. On the reverse movement of the barrel 14, the notch 140 of the finger 132 engages the forward top edge 156 of the hammer shell 138 and drives the same in a rearward (counterclockwise direction as shown) direction to a point where the sear notch 92 and the sear 94 engage one another, thus fully cocking the weapon.

Once each cartridge in the cylinder-like cartridge carrier 38 has been expended, the handgun may be unloaded by first pulling down lever 124 so as to disengage boss 128 from the forward portion of depending lug 121 which permits the barrel 14 and barrel carrier 16 to be moved forwardly together and pivoted about pin 131 to the open position shown in FIG. 8. At this point, the cylinder 38 may be removed from the tapered mounting member 37 on tube 30 and rods 170 which are fixed in the butt of grip 18 may be used to remove the spent cartridges from said cylinder 38 two at a time.

While the description and operation of the handgun of the present invention is primarily directed for use with a 0.22 cartridge, it will be understood by those skilled in the art that it may be adapted for 0.45 ACP as well as other types of cartridges.

What is claimed is:

1. A handgun comprising in combination a frame, a barrel carrier pivotally mounted in and removable from said frame, a barrel slidably disposed in said barrel carrier for forward and reverse movement thereof in response to firing said handgun, a cylinder-like cartridge carrier rotatably disposed adjacent the breech end of said barrel carrier, said cartridge carrier having projections extending forwardly therefrom parallel to the axis of said cartridge carrier, a counterbore in said breech end of said barrel for receiving a projection of said cartridge carrier, a lockwork mechanism for firing said handgun and means for indexing said cartridge carrier in response to said forward and reverse movement of said barrel, said indexing means comprising a pair of indexing levers pivotally disposed on said frame beneath said barrel and barrel carrier, said levers having cam followers disposed thereon adjacent the forward end thereof and pusher teeth disposed thereon adjacent the breech end thereof, a cam affixed to said barrel and movable therewith, said cam and cam followers being engageable with one another, said indexing means further comprising a toothed periphery about said cylinder-like cartridge carrier engageable with said pusher teeth whereby forward and reverse movement of said barrel causes said cam to pivot said levers thereby indexing said cartridge carrier.

2. The handgun of claim 1 wherein said indexing levers rotate said cartridge carrier independently of one another.

3. The handgun of claim 1 further including cocking means for said lockwork mechanism, said cocking means being activated by said barrel movement.

4. The handgun of claim 3 wherein said cocking means includes a cocking finger disposed on the breech end of said barrel and engageable with said lockwork mechanism during reverse movement of said barrel.

5. The handgun of claim 1 wherein said counterbore is provided with a shoulder at the bottom thereof whereby pressure against said shoulder developed as a result of firing a cartridge forces said barrel forwardly.

6. The handgun of claim 5 further including recoil means for urging said barrel rearwardly from its forwardmost position.

7. The handgun of claim 6 wherein said recoil means includes at least one spring disposed between said barrel and said barrel carrier whereby forward movement of said barrel compresses said spring.

8. The handgun of claim 5 wherein said counterbore includes an annular groove around the periphery thereof, said annular groove functioning as a gas seal when said handgun is fired.

9. The handgun of claim 1 wherein front and rear sights are affixed to said barrel, said rear sight comprising identical blades having independent lateral adjustment.

10. The handgun of claim 1 wherein said cartridge carrier comprises a cylindrical base member having said toothed periphery and a central, axially tapered mounting aperture therein and said projections comprise a plurality of bushings integral with said base member and generally evenly spaced therearound, each of said bushings being chamferred at the forward end thereof for ease in reception within said barrel counterbore.

* * * * *